US007972709B2

(12) United States Patent
Hatano

(10) Patent No.: US 7,972,709 B2
(45) Date of Patent: Jul. 5, 2011

(54) CU-ZN ALLOY STRIP SUPERIOR IN THERMAL PEEL RESISTANCE OF SN PLATING AND SN PLATING STRIP THEREOF

(75) Inventor: Takaaki Hatano, Koza-gun (JP)

(73) Assignee: JX Nippon Mining & Metals Co., Ltd., Tokyo (JP)

( * ) Notice: Subject to any disclaimer, the term of this patent is extended or adjusted under 35 U.S.C. 154(b) by 93 days.

(21) Appl. No.: 12/227,765

(22) PCT Filed: May 28, 2007

(86) PCT No.: PCT/JP2007/060838

§ 371 (c)(1),
(2), (4) Date: Nov. 26, 2008

(87) PCT Pub. No.: WO2007/139072

PCT Pub. Date: Dec. 6, 2007

(65) Prior Publication Data

US 2009/0239094 A1 Sep. 24, 2009

(30) Foreign Application Priority Data

May 29, 2006 (JP) ..... 2006-148597

(51) Int. Cl.
*B32B 15/01* (2006.01)
*B32B 15/04* (2006.01)
*B32B 15/20* (2006.01)

(52) U.S. Cl. ..... 428/647; 428/607; 428/674; 428/675; 428/215; 428/220; 428/336

(58) Field of Classification Search ..... 428/606, 428/607, 646, 647, 674, 675, 658, 212, 213, 428/214, 215, 216, 220, 332, 334, 335, 336
See application file for complete search history.

(56) References Cited

U.S. PATENT DOCUMENTS

| | | | | |
|---|---|---|---|---|
| 6,040,067 | A | 3/2000 | Sugawara et al. | 428/647 |
| 2003/0129441 | A1 | 7/2003 | Hara et al. | 428/647 |
| 2009/0092851 | A1 * | 4/2009 | Hatano | 428/647 |

FOREIGN PATENT DOCUMENTS

| | | |
|---|---|---|
| JP | 60-086230 | 5/1985 |
| JP | 6-196349 | 7/1994 |
| JP | 10-025562 | 1/1998 |
| JP | 2000-303128 | 10/2000 |
| JP | 2003-293056 | 10/2003 |

(Continued)

OTHER PUBLICATIONS

Machine Translation, Hatano et al, JP 2007-051370, Mar. 2007.*

(Continued)

*Primary Examiner* — Michael La Villa
(74) *Attorney, Agent, or Firm* — Drinker Biddle & Reath LLP

(57) ABSTRACT

A Cu—Zn alloy strip and Sn plating strip thereof having improved thermal peel resistance of Sn Plating is provided. In a Cu—Zn alloy strip comprising 15 to 40% by mass of Zn and a balance of Cu and unavoidable impurities, the total concentration of P, As, Sb and Bi is regulated to 100 ppm by mass or less, the total concentration of Ca and Mg is regulated to 100 ppm by mass or less, and the concentrations of O and S are each regulated to 30 ppm by mass or less.

4 Claims, 1 Drawing Sheet

FOREIGN PATENT DOCUMENTS

| | | | |
|---|---|---|---|
| JP | 2003-293187 | | 10/2003 |
| JP | 2004-068026 | | 3/2004 |
| JP | 2005-226097 | | 8/2005 |
| JP | 2007-051370 | * | 3/2007 |

OTHER PUBLICATIONS

TradeKorea, "Brass Copper," no date, downloaded from www.tradeKorea.com on Sep. 28, 2010, (two pages).*

Shanghai Metal Corporation, "Product Specifications of Brass Strip and Products," Jun. 2006, downloaded from www.shanghaimetal.com on Sep. 28, 2010, (two pages).*

N.S. Metal, "Copper and Copper Alloy Tube," Aug. 2005, downloaded from www.nsmetal.com on Sep. 28, 2010, (two pages).*

Japan Industrial Standard J1S H 2121 "*Electrolytic Cathode Copper*" (1961).

* cited by examiner

CU-ZN ALLOY STRIP SUPERIOR IN THERMAL PEEL RESISTANCE OF SN PLATING AND SN PLATING STRIP THEREOF

TECHNICAL FIELD

The present invention relates to a Cu—Zn alloy strip superior in thermal peel resistance of Sn Plating and an Sn plating strip thereof that are suitable as electrically conductive materials such as a connector, a terminal, a relay, and a switch.

BACKGROUND OF THE INVENTION

Although Cu—Zn alloy has lower spring properties compared to phosphor bronze, beryllium copper, and Corson alloy etc., it is cheaper and is thus widely used as electric contact materials such as a connector, a terminal, a relay, and a switch. Representative Cu—Zn alloy is brass, and alloys such as C2600 and C2680 are specified in JIS H3100. When using Cu—Zn alloy for an electric contact material, it is often applied Sn plating to obtain stably low contact resistance. Taking advantage of superior solderability, corrosion resistance, and electrical connectability of Sn, Sn plating strip of Cu—Zn alloy is used in large amounts in a terminal for wire harness of automotive electrical equipments, a terminal for printed circuit board (PBC), and electrical and electronic parts of a connector contact for household appliances etc.

Typically, when a reflow Sn plating strip of copper alloy is kept at an elevated temperature for a long period of time, a phenomenon in which the plating layer is peeled off from the base material occurs (hereinafter referred to as thermal peeling). When Zn is added to the copper alloy, thermal peeling property will be improved. Accordingly, the thermal peel resistance of Cu—Zn alloy is relatively good.

The above Sn plating strip of Cu—Zn alloy is manufactured in the steps of degreasing and pickling, and then formation of an undercoat layer by electroplating, followed by formation of an Sn plating layer by electroplating, and finally application of reflow treatment to melt the Sn plating layer.

A common undercoat for the Cu—Zn alloy Sn plating strip is a Cu undercoat. For applications that require thermal resistance, a Cu/Ni bilayer undercoat may be applied. As used herein, a Cu/Ni bilayer undercoat is a plating in which electroplating is performed in the order of an Ni undercoat, a Cu undercoat, and an Sn plating, and then reflow treatment is applied. The constitution of the plating coating layer after reflow treatment will be, from the surface, the Sn phase, the Cu—Sn phase, the Ni phase, and then the base material.

Details on this technology are disclosed in the following patent application documents 1-3 (Japanese Published Unexamined Application 6-196349, Japanese Published Unexamined Application 2003-293187, and Japanese Published Unexamined Application 2004-68026).

DISCLOSURE OF THE INVENTION

Problems to be Solved by the Invention

In recent years, however, reliability for thermal peel resistance at a higher elevated temperatures for a long period of time have been desired, and better thermal peel resistance is also desired of conventional Cu—Zn alloys having relatively good thermal peel resistance.

The object of the present invention is to provide a Cu—Zn alloy tin plating strip having improved tin plating thermal peel resistance, and in particular, to provide a Cu—Zn alloy tin plating strip having improved thermal peel resistance in regards to the Cu undercoat or the Cu/Ni bilayer undercoat.

Means to Solve the Problem

The present inventor has extensively researched measures to improve the thermal peel resistance of reflow Sn plating strips of Cu—Zn alloy. As a result, he has found that thermal peel resistance can be greatly improved by regulating the concentrations of S, O, P, As, Sb, Bi, Ca and Mg.

The present invention is based on this finding, and is as follows.

(1) A Cu—Zn alloy strip superior in thermal peel resistance of Sn Plating, characterized in that it comprises 15 to 40% by mass of Zn and a balance of Cu and unavoidable impurities, wherein in the unavoidable impurities, the total concentration of P, As, Sb and Bi is 100 ppm by mass or less, the total concentration of Ca and Mg is 100 ppm by mass or less, the concentration of O is 30 ppm by mass or less, and the concentration of S is 30 ppm by mass or less.

(2) The Cu—Zn alloy strip according to (1), characterized in that it comprises one or more of Sn, Ni, Si, Fe, Mn, Co, Ti, Cr, Zr, Al and Ag in the range of 0.01 to 5.0% by mass.

(3) A Cu—Zn alloy Sn plating strip superior in thermal peel resistance, characterized in that it has the Cu—Zn alloy strip according to (1) or (2) as a base material, and that the plating coating is constructed from the surface to the base material by each layers of an Sn phase, an Sn—Cu alloy phase, and a Cu phase surface, wherein the thickness of the Sn phase is 0.1 to 1.5 μm, the thickness of the Sn—Cu alloy phase is 0.1 to 1.5 μm, and the thickness of the Cu phase is 0 to 0.8 μm.

(4) A Cu—Zn alloy Sn plating strip superior in thermal peel resistance, characterized in that it has the Cu—Zn alloy strip according to (1) or (2) as a base material, and that the plating coating is constructed from the surface to the base material by each layers of an Sn phase, Sn—Cu alloy phase, and an Ni phase, wherein the thickness of the Sn phase is 0.1 to 1.5 μm, the thickness of the Sn—Cu alloy phase is 0.1 to 1.5 μm, and the thickness of the Ni phase is 0.1 to 0.8 μm.

There are two ways of Sn plating of the Cu—Zn alloy: performing the plating before press processing into parts (pre-plating) and after press processing (post-plating). The effects of the present invention can be obtained in both cases.

Figure 1:
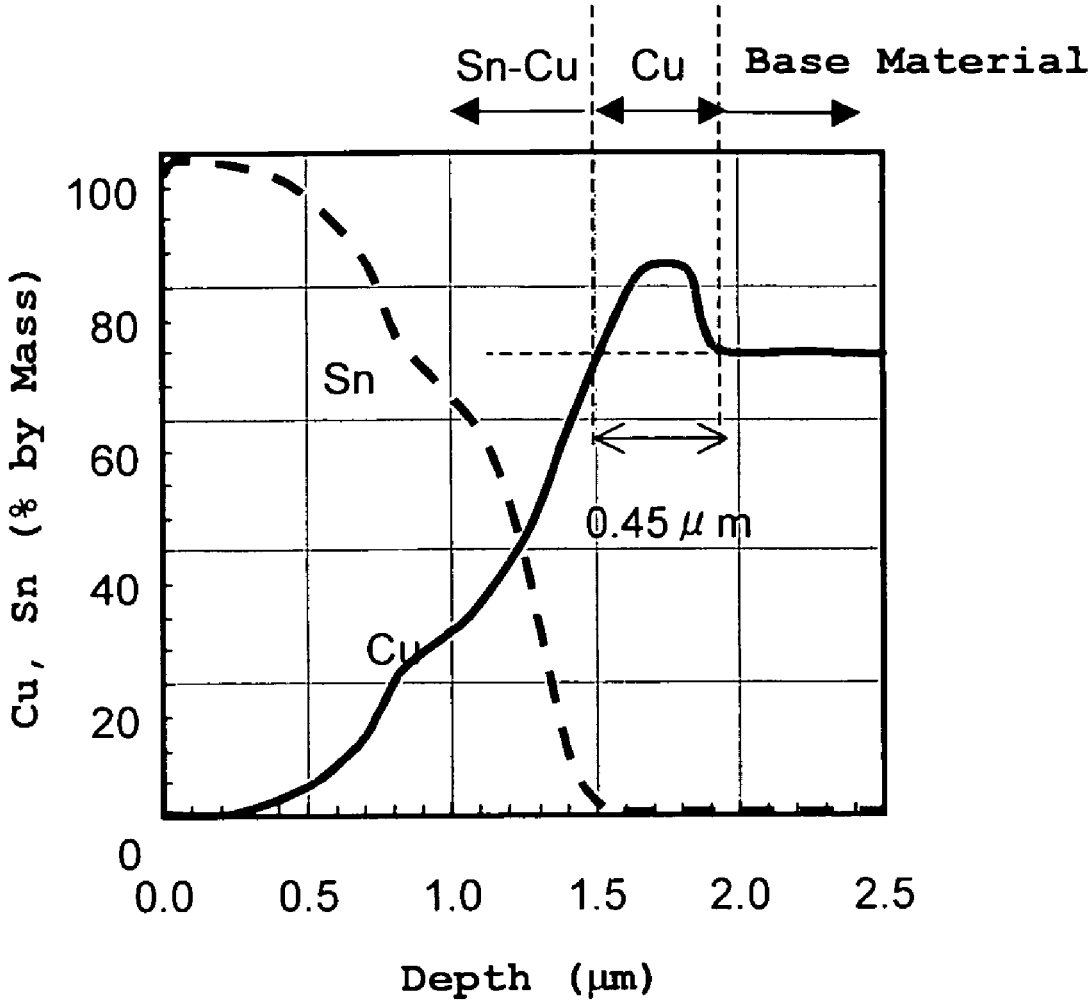
FIG. 1 shows the profile of the copper concentration of the sample from Example 23 (Table 2, Cu undercoat) in the depth direction.

BEST MODE FOR CARRYING OUT THE INVENTION (1) Components of the Base Material (I) Alloy Element The present invention directs to a copper alloy comprising 15 to 40% by mass of Zn. The effects of the invention will not be exhibited in a copper alloy comprising Zn outside of this range.

An example of a copper alloy comprising 15 to 40% by mass of Zn is brass. JIS-H3100 specifies brass such as C2600, C2680, and C2720. When Zn is greater than 40% by mass, manufacturability will be reduced and decrease in electric conductivity will be enhanced. When Zn is less than 15% by mass, strength will be insufficient. Zn is preferably 27 to 38% by mass.

To the alloy of the present invention, with an object to improve the strength, thermal resistance, stress relaxation resistance etc. of the alloy, one or more of Sn, Ni, Si, Fe, Mn, Co, Ti, Cr, Zr, Al and Ag can further be added in a total amount of 0.01 to 5.0% by mass. However, it is necessary to consider that addition of an alloy element may lead to decrease in electric conductivity, decrease in manufacturability, and increase in material cost, etc. When the total amount of these elements is less than 0.01% by mass, effects of improving the properties will not be exhibited. On the other hand, when the total amount of the above elements is greater than 5.0% by mass, decrease in electric conductivity will be significant. Accordingly, the total amount is specified at 0.01 to 5.0 by mass. The total amount is preferably 0.1 to 3.0% by mass.

(II) Impurities

P, As, Sb and Bi of the VB group are elements that accelerate thermal peeling by concentrating at the interface between the plating and the base material. The concentrations of these are therefore regulated to a total amount of 100 ppm by mass or less. The concentration is more preferably 5 ppm by mass or less.

P is an element often used as a deoxidizing agent or an alloy element of copper alloy. For example, as described in Japanese Published Unexamined Application 60-86230, P can be added to a Cu—Zn alloy to improve properties. To keep the concentration of P low, it is necessary, needless to say, neither to add P as a deoxidizing agent or an alloy element, nor to use as material any copper alloy scraps comprising P.

As, Sb and Bi are representative impurities that are contained in electrolytic cathode copper which is the main material for wrought copper and copper alloy. To keep the concentrations of these low, it is necessary to avoid employment of low-purity electrolytic cathode copper.

Although the lower limit of the total concentration of P, As, Sb and Bi is not particularly regulated, a tremendous refining cost will be necessary if it was to be lowered to less than 1 ppm by mass. It is therefore typically 1 ppm by mass or more.

Further, Mg and Ca are elements other than P, As, Sb, and Bi that accelerate thermal peeling by concentrating at the interface between the plating and the base material. The concentrations of Mg and Ca are therefore regulated to a total of 100 ppm by mass or less. The concentration is more preferably 5 ppm by mass or less.

Mg is an element often used as a deoxidizing agent or an alloy element of copper alloy. Particularly, it is often used as an additive component because the effect of Mg against stress relaxation property is significant. To keep the concentration of Mg low, it is necessary, needless to say, neither to add Mg as a deoxidizing agent or an alloy element, nor to use as material any copper ally scraps comprising Mg.

Ca is an element that is easily introduced from refractory materials and covering materials of molten metal etc. during manufacture of Cu—Zn alloy ingot. It is vital that any material used that will come in contact with molten metal do not comprise Ca.

Although the lower limit of the total concentration of Mg and Ca is not particularly regulated, a tremendous refining cost will be necessary if it was to be lowered to less than 0.5 ppm by mass, and it is therefore typically 0.5 ppm by mass or more.

Concentrations of each of O and S are regulated to 30 ppm by mass or less. When either concentration is greater than 30 ppm by mass, thermal peel resistance of Sn plating will be reduced. To keep the concentration of O low, it is effective to cover the molten metal surface with charcoal during manufacture of ingot. In this case, it is vital to use a well-dried charcoal, since any moisture adsorbed onto the charcoal will be the contamination source of oxygen. In addition, concomitant use of coating by molten salt constituted of chlorides or fluorides with covering by charcoal will cause blocking of the molten metal from air, therefore leading to higher deoxidation effect.

To keep the concentration of S low, it is necessary to prevent S contamination from refractory materials and covering materials of molten metal etc. that will come in contact with raw material and molten metal. It is necessary to carefully select the qualities of these, although S contained in molten metal can be removed by adding desulfurizing agents such as $Na_2CO_3$ to the molten metal.

(2) Thickness of the Plating (2-1) Cu Undercoat

In the case of a Cu undercoat, Cu and Sn plating layers are sequentially formed by electroplating on the Cu—Zn alloy base material, and then reflow treatment is performed. By this reflow treatment, the Cu plating layer and the Sn plating layer react each other to form Sn—Cu alloy phase, and the structure of the plating layer will be, from the surface side, the Sn phase, the Sn—Cu alloy phase, and then the Cu phase.

The thicknesses of each of these phases after reflow treatment are adjusted to the following ranges:

Sn phase: 0.1 to 1.5 μm,

Sn—Cu alloy phase: 0.1 to 1.5 μm, and

Cu phase: 0 to 0.8 μm.

When the Sn phase is less than 0.1 μm, solderability will be reduced, and when it is greater than 1.5 μm, the thermal stress generated within the plating layer upon heating will be increased, therefore accelerating plate peeling. The range is more preferably 0.2 to 1.0 μm.

Because the Sn—Cu alloy phase is hard, it will contribute to decrease in insertion force when it exists at a thickness of 0.1 μm or more. On the other hand, when the thickness of the Sn—Cu alloy phase is greater than 1.5 μm, the thermal stress generated within the plating layer upon heating will be increased, therefore accelerating plate peeling. The thickness is more preferably 0.5 to 1.2 μm.

For the Cu—Zn alloy, solderability will be improved by performing a Cu undercoat. Accordingly, it is necessary to apply a Cu undercoat of 0.1 μm or more during electrodeposition. This Cu undercoat may be consumed and disappear upon formation of the Sn—Cu alloy phase during reflow treatment. In other words, the lower limit of the thickness of the Cu phase after reflow treatment is not regulated, and the thickness may become zero.

The upper limit of the thickness of the Cu phase is 0.8 μm or less after reflow treatment. When it is greater than 0.8 μm, the thermal stress generated within the plating layer upon heating will be increased, therefore accelerating plate peeling. The thickness of the Cu phase is more preferably 0.4 μm or less.

To obtain the above plating structure, the thicknesses of each plating during electroplating are appropriately adjusted in the range of 0.5 to 1.8 μm for the Sn plating, and in the range of 0.1 to 1.2 μm for the Cu plating, and then the reflow treatment is performed under appropriate conditions in the range of 230 to 600° C. for 3 to 30 seconds.

(2-2) Cu/Ni Undercoat

In the case of a Cu/Ni undercoat, Ni, Cu and Sn plating layers are sequentially formed by electroplating on the Cu—Zn alloy base material, and then reflow treatment is performed. By this reflow treatment, the Cu plating reacts with Sn to become Sn—Cu alloy phase, and the Cu phase will disappear. On the other hand, the Ni layer will remain almost maintaining the thickness of the state immediately after electroplating. As a result, the structure of the plating layer will be, from the surface side, the Sn phase, the Sn—Cu alloy phase, and then the Ni phase.

The thicknesses of each of these phases after reflow treatment are adjusted to the following ranges:

Sn phase: 0.1 to 1.5 μm,

Sn—Cu alloy phase: 0.1 to 1.5 μm, and

Ni phase: 0.1 to 0.8 μm.

When the Sn phase is less than 0.1 μm, solderability will be reduced, and when it is greater than 1.5 μm, the thermal stress generated within the plating layer upon heating will be increased, therefore accelerating plate peeling. The range is more preferably 0.2 to 1.0 μm.

Because the Sn—Cu alloy phase is hard, it will contribute to decrease in insertion force when it exists at a thickness of 0.1 μm or more. On the other hand, when the thickness of the Sn—Cu alloy phase is greater than 1.5 μm, the thermal stress generated within the plating layer upon heating will be increased, therefore accelerating plate peeling. The thickness is more preferably 0.5 to 1.2 μm.

The thickness of the Ni phase is 0.1 to 0.8 μm. When the thickness of Ni is less than 0.1 μm, the corrosion resistance and thermal resistance of the plating will be reduced. When the thickness of Ni is greater than 0.8 μm, the thermal stress generated within the plating layer upon heating will be increased, therefore accelerating plate peeling. The thickness of the Ni phase is more preferably 0.1 to 0.3 μm.

To obtain the above plating structure, the thicknesses of each plating during electroplating are appropriately adjusted in the range of 0.5 to 1.8 μm for the Sn plating, in the range of 0.1 to 0.4 μm for the Cu plating, and in the range of 0.1 to 0.8 μm for the Ni plating, and then the reflow treatment is performed under appropriate conditions in the range of 230 to 600° C. for 3 to 30 seconds.

EXAMPLES

Manufacturing, plating, and measurement methods employed in the Example of the present invention will be shown below.

Using a commercially available electrolytic cathode copper as an anode, electrolysis was performed in a copper nitrate bath to deposit highly pure copper at a cathode. The concentrations of P, As, Sb, Bi, Ca, Mg and S in this highly pure copper were all less than 1 ppm by mass. This highly pure copper was used as the experiment material in the following.

Using a high-frequency induction furnace, 2 kg of the highly pure copper was melted in a graphite crucible having an internal diameter of 60 mm and a depth of 200 mm. After covering the molten metal surface with pieces of charcoal, a predetermined amount of Zn and other alloy elements were added. Next, P, As, Sb, Bi, Ca, Mg and S were add to adjust the concentrations of impurities. When a sample with high concentration of O is to be produced, a part of the molten metal surface was exposed from the covered charcoal.

Subsequently, the molten metal was casted into a die to manufacture an ingot having a width of 60 mm and a thickness of 30 mm, and then processed to obtain a reflowed Sn plating material with Cu undercoat and a reflowed Sn plating material with Cu/Ni undercoat using the following steps.

(Step 1) Heating at 800° C. for 3 hours, and then hot rolling to a plate thickness of 8 mm.

(Step 2) With a grinder, grinding to remove oxide scale on the hot rolled plate surface.

(Step 3) Cold rolling to a plate thickness of 1.5 mm.

(Step 4) As recrystallization annealing, heating at 400° C. for 30 minutes.

(Step 5) Sequentially performing pickling with 10% by mass sulfuric acid/1% by mass hydrogen peroxide solution and mechanical polishing with #1200 emery paper to remove surface oxide film.

(Step 6) Cold rolling to a plate thickness of 0.43 mm.

(Step 7) As recrystallization annealing, heating at 400° C. for 30 minutes.

(Step 8) Performing pickling with 10% by mass sulfuric acid/1% by mass hydrogen peroxide solution to remove a surface oxide film.

(Step 9) Cold rolling to a plate thickness of 0.3 mm.

(Step 10) Performing electrolysis degreasing under the following conditions in an alkali aqueous solution using the samples as cathodes:

Current density: 3 A/dm$^2$. Degreasing agent: PAKUNA P105™ from YUKEN INDUSTRY CO., LTD. Concentration of degreasing agent: 40 g/L. Temperature: 50° C.

Time: 30 seconds. Current density: 3 A/dm$^2$.

(Step 11) Performing pickling with 10% by mass sulfuric acid aqueous solution.

(Step 12) Applying Ni undercoat under the following conditions (only in the case of Cu/Ni undercoat):

Composition of plating bath: 250 g/L of nickel sulfate, 45 g/L of nickel chloride, and 30 g/L of boric acid.

Plating bath temperature: 50° C.

Current density: 5 A/dm$^2$.

Ni plating thickness is adjusted according to electrodeposition time.

(Step 13) Applying Cu undercoat under the following conditions:

Composition of plating bath: 200 g/L of copper sulfate and 60 g/L of sulfuric acid.

Plating bath temperature: 25° C.

Current density: 5 A/dm$^2$.

Cu plating thickness is adjusted according to electrodeposition time.

(Step 14) Applying Sn plating under the following conditions:

Composition of plating bath: 41 g/L of stannous oxide, 268 g/L of phenolsulfonic acid, and 5 g/L of surface active agent.

Plating bath temperature: 50° C.

Current density: 9 A/dm$^2$.

Sn plating thickness is adjusted according to electrodeposition time.

(Step 15) As reflow treatment, inserting the sample into a furnace adjusted to a temperature of 400° C. and atmosphere gas to nitrogen (1 vol % or less of oxygen) for 10 seconds, and then cooling with water.

The following evaluations were performed on the samples prepared as described above (a) Composition Analysis of the Base Material After completely removing the plating layer by mechanical polishing and chemical etching, the concentrations of Zn and Sn were measured by ICP-emission spectrometry, the concentrations of P, As, Sb, Bi, Ca, Mg and S were measured by ICP-mass spectrometry, and the concentration of O was measured by inert gas melting-infrared absorption method.

(b) Plating Thickness Measurement by Coulometric Thicknessmeter

The thicknesses of Sn and Sn—Cu alloy phases were measured on the samples after reflow treatment. The thicknesses of Cu and Ni phases cannot be measured with this method.

(c) Plating Thickness Measurement by GDS

After ultrasound degreasing in acetone of the samples after reflow treatment, the concentration profiles of Sn, Cu, and Ni in the depth direction were determined by GDS (glow discharge atomic emission spectrochemical analysis device.) The measurement conditions were as follows:

Device: JY5000RF-PSS from JOBIN YVON.

Current Method Program: CNBinteel-12aa-0.

Mode: Constant Electric Power=40 W.

Ar-Presser: 775 Pa.

Current Value: 40 mA (700V).

Flush Time: 20 sec.

Preburn Time: 2 sec.

Determination Time Analysis Time=30 sec, Sampling Time=0.020 sec/point.

The thickness of the Cu undercoat (Cu phase) remaining after reflow treatment was determined from the Cu concentration profile data obtained by GDS. The data of Example 23 (Table 2, Cu undercoat) described below as a representative concentration profile of GDS is shown in FIG. 1. An area where the concentration of Cu is higher than the base material is seen at the depth of 1.7 μm. This area is the Cu undercoat layer remaining after reflow treatment, and the thickness of this layer was read as the thickness of the Cu phase. If no area where the concentration of Cu is higher than the base material is seen, the Cu undercoat was considered disappeared (the thickness of the Cu phase is zero.). Similarly, the thickness of the Ni undercoat (Ni phase) was determined from the Ni concentration profile data.

(d) Thermal Peel Resistance

The sample strip having a width of 10 mm was taken, and heated at a temperature of 105° C. or 150° C. under atmosphere to 3000 hours. During this heating, the sample was taken out of the furnace every 100 hours to perform a 90° bending and backbending with a bending radius of 0.5 mm (a round-trip 90° bending). Then, the inside surface of the bent sample was observed with an optical microscope (50× magnification) to investigate the existence of plate peeling.

Examples 1 to 20 and Comparative Examples 1 to 7

The Example investigating the influence of impurities of the base material on the thermal peel resistance is shown in Table 1.

TABLE 1

| | Concentration (% by Mass) | | Concentration (ppm by Mass) | | | | | | | | | | Plate peeling Time (h) | | | |
|---|---|---|---|---|---|---|---|---|---|---|---|---|---|---|---|---|
| | | | S, O | | P, As, Sb, Bi | | | | | Mg, Ca | | | Cu Undercoat | | Cu/Ni Undercoat | |
| | Zn | Others | S | O | P | As | Sb | Bi | Total | Mg | Ca | Total | 105° C. | 150° C. | 105° C. | 150° C. |
| Ex. 1 | 30.0 | — | 10 | 18 | 0.8 | 1.4 | 0.7 | 0.1 | 3.0 | 2.3 | 2.3 | 4.6 | >3000 | >3000 | >3000 | >3000 |
| Ex. 2 | 30.5 | — | 9 | 21 | 22.6 | 0.7 | 0.6 | 1.1 | 25.0 | 2.2 | 1.9 | 4.1 | >3000 | >3000 | >3000 | >3000 |
| Ex. 3 | 30.2 | — | 11 | 20 | 43.5 | 1.0 | 1.2 | 1.3 | 47.0 | 2.0 | 2.4 | 4.4 | >3000 | >3000 | >3000 | >3000 |
| Ex. 4 | 30.3 | — | 10 | 19 | 85.3 | 1.4 | 3.9 | 0.2 | 90.8 | 2.6 | 1.6 | 4.2 | >3000 | >3000 | >3000 | >3000 |
| Ex. 5 | 35.0 | — | 21 | 22 | 0.8 | 1.2 | 0.9 | 0.1 | 3.0 | 2.2 | 2.3 | 4.5 | >3000 | >3000 | >3000 | >3000 |
| Ex. 6 | 35.2 | — | 20 | 23 | 0.9 | 0.5 | 0.8 | 0.0 | 2.2 | 20.5 | 20.9 | 41.4 | >3000 | >3000 | >3000 | >3000 |
| Ex. 7 | 35.1 | — | 22 | 24 | 0.7 | 0.8 | 0.5 | 0.1 | 2.1 | 19.5 | 39.6 | 59.1 | >3000 | >3000 | >3000 | >3000 |
| Ex. 8 | 35.2 | — | 21 | 24 | 0.6 | 0.9 | 0.7 | 0.0 | 2.2 | 41.3 | 20.9 | 62.2 | >3000 | >3000 | >3000 | >3000 |
| Ex. 9 | 35.1 | — | 21 | 22 | 1.2 | 0.9 | 0.9 | 0.1 | 3.1 | 40.9 | 41.5 | 82.4 | >3000 | >3000 | >3000 | >3000 |
| Ex. 10 | 15.6 | — | 17 | 20 | 15.6 | 1.2 | 0.6 | 1.1 | 18.5 | 10.5 | 11.0 | 21.5 | >3000 | >3000 | >3000 | >3000 |
| Ex. 11 | 20.4 | — | 12 | 9 | 2.5 | 0.8 | 0.8 | 0.6 | 4.7 | 5.4 | 9.9 | 15.3 | >3000 | >3000 | >3000 | >3000 |
| Ex. 12 | 25.3 | — | 9 | 22 | 13.6 | 1.1 | 1.6 | 0.7 | 17.0 | 1.1 | 5.3 | 6.4 | >3000 | >3000 | >3000 | >3000 |
| Ex. 13 | 39.5 | — | 11 | 20 | 8.9 | 1.3 | 0.7 | 0.2 | 11.1 | 10.9 | 1.1 | 12.0 | >3000 | >3000 | >3000 | >3000 |
| Ex. 14 | 20.6 | 1.6Ni, 0.40Si, 0.30Sn | 16 | 9 | 38.4 | 11.6 | 0.8 | 1.4 | 52.2 | 2.3 | 8.9 | 11.2 | >3000 | >3000 | >3000 | >3000 |
| Ex. 15 | 21.2 | 1.1Ni, 3.2Al | 9 | 15 | 24.1 | 1.3 | 0.7 | 0.2 | 26.3 | 0.5 | 0.7 | 1.2 | >3000 | >3000 | >3000 | >3000 |
| Ex. 16 | 25.4 | 0.82Sn | 19 | 22 | 15.1 | 0.5 | 1.3 | 0.2 | 17.1 | 1.3 | 10.9 | 12.2 | >3000 | >3000 | >3000 | >3000 |
| Ex. 17 | 30.5 | 0.25Ag | 20 | 15 | 0.4 | 1.3 | 5.5 | 0.1 | 7.3 | 0.4 | 0.4 | 0.8 | >3000 | >3000 | >3000 | >3000 |
| Ex. 18 | 28.6 | 0.05Ti, 0.10Co | 17 | 18 | 2.2 | 1.4 | 2.2 | 0.0 | 5.8 | 16.2 | 3.5 | 19.7 | >3000 | >3000 | >3000 | >3000 |
| Ex. 19 | 24.2 | 0.05Zr, 0.10Cr | 28 | 26 | 15.5 | 1.2 | 1.1 | 0.6 | 18.4 | 8.6 | 15.6 | 24.2 | >3000 | >3000 | >3000 | >3000 |
| Ex. 20 | 31.5 | 0.15Fe, 0.20Mn | 4 | 21 | 11.4 | 0.8 | 0.9 | 0.3 | 13.4 | 2.1 | 3.0 | 5.1 | >3000 | >3000 | >3000 | >3000 |
| Com. 1 | 30.2 | — | 11 | 19 | 87.1 | 6.5 | 12.0 | 0.1 | 105.7 | 2.0 | 2.3 | 4.3 | >3000 | 1500 | >3000 | 2700 |
| Com. 2 | 30.0 | — | 9 | 20 | 99.2 | 19.6 | 8.5 | 1.9 | 129.2 | 1.9 | 2.5 | 4.4 | 2500 | 900 | >3000 | 1900 |
| Com. 3 | 30.1 | — | 10 | 20 | 164.3 | 1.5 | 1.6 | 1.2 | 168.6 | 2.3 | 2.2 | 4.5 | 1300 | 600 | 2800 | 1400 |
| Com. 4 | 35.1 | — | 20 | 21 | 1.0 | 0.8 | 1.1 | 0.1 | 3.0 | 20.7 | 84.6 | 105.3 | 2300 | >3000 | 2700 | >3000 |
| Com. 5 | 35.0 | — | 21 | 23 | 1.2 | 0.4 | 0.7 | 0.3 | 2.6 | 98.3 | 22.2 | 120.5 | 2000 | >3000 | 2400 | >3000 |
| Com. 6 | 30.2 | — | 34 | 22 | 0.8 | 1.6 | 0.8 | 0.1 | 3.3 | 2.3 | 0.7 | 3.0 | 800 | 900 | 1700 | 2000 |
| Com. 7 | 30.1 | — | 11 | 32 | 1.0 | 1.3 | 0.8 | 0.1 | 3.2 | 2.6 | 1.4 | 4.0 | 700 | 900 | 1900 | 1700 |

"—" in the Table represents no addition.

For the Cu undercoat material, electroplating was performed with the thickness of Cu at 0.3 μm and the thickness of Sn at 0.8 μm, and then reflow treatment was performed at 400° C. for 10 seconds. In all Examples and Comparative Examples, the thickness of the Sn phase was about 0.4 μm, the thickness of the Cu—Sn alloy phase was about 1 μm, and the Cu phase had disappeared.

For the Cu/Ni undercoat material, electroplating was performed with the thickness of Ni at 0.2 μm, the thickness of Cu at 0.3 μm, and the thickness of Sn at 0.8 μm, and then reflow treatment was performed at 400° C. for 10 seconds. In all Examples and Comparative Examples, the thickness of the Sn phase was about 0.4 μm, the thickness of the Cu—Sn alloy phase was about 1 μm, the Cu phase had disappeared, and the Ni phase remained having the thickness immediately after electrodeposition (0.2 μm).

In Examples 1 to 20 which are the alloys of the present invention, whether it had a Cu undercoat or a Cu/Ni undercoat, plate peeling had not occurred when heated at both 105° C. and 150° C. for 3000 hours.

In Examples 1 to 4 and Comparative Examples 1 to 3, the concentrations of P, As, Sb and Bi were altered under the condition of low Mg, Ca, S, and O concentrations. When the total concentration of P, As, Sb, and Bi was greater than 100 ppm by mass, whether it had a Cu undercoat or a Cu/Ni undercoat, the peeling time at 150° C. was shorter than 3000 hours. The reduction in peeling time was more significant with a higher total concentration of P, As, Sb, and Bi at both 105° C. and 150° C. In addition, since the peeling time at 150° C. was shorter than the peeling time at 105° C., it can be said that adverse effects of P, As, Sb, and Bi were expressed more significantly at 150° C.

In Examples 5 to 9 and Comparative Examples 4 to 5, the concentrations of Mg and Ca were altered under the condition of low P, As, Sb, Bi, S, and O concentrations. When the total concentration of Mg and Ca was greater than 100 ppm by mass, whether it had a Cu undercoat or a Cu/Ni undercoat, the peeling time at 105° C. was shorter than 3000 hours. On the other hand, since reduction of peeling time was not seen at 150° C., it can be said that adverse effects of Mg and Ca were expressed more significantly at 105° C.

Comparative Examples 6 and 7 are alloys having greater than 30 ppm by mass of S and O, respectively. In both examples, whether it had a Cu undercoat or a Cu/Ni undercoat, the peeling time at 105° C. and 150° C. was shorter than 3000 hours.

In Examples 10 to 13, the concentration of Zn was altered within the range of the present invention, but plate peeling had not occurred after 3000 hours in any of them. In addition, in Examples 14 to 20, at least one selected from the group of Sn, Ni, Si, Fe, Mn, Co, Ti, Cr, Zr, Al and Ag was add within the range of the present invention, but plate peeling had not occurred after 3000 hours in any of them.

Examples 21 to 35 and Comparative Examples 8 to 13

The Examples investigating the influence of the thickness of the plating on the thermal peel resistance are shown in Tables 2 and 3. The composition of the base material was: Cu-30.0% by mass Zn, the total concentration of P, As, Sb and Bi was 3.2 ppm by mass, the total concentration of Mg and Ca was 2.1 ppm by mass, the concentration of O was 18 ppm by mass, and the concentration of S was 12 ppm by mass.

TABLE 2

| | | Thickness After Electrodeposition (μm) | | | Thickness After Reflow (μm) | | | Plate peeling Time (h) | |
|---|---|---|---|---|---|---|---|---|---|
| | No. | Sn Phase | Cu Phase | Reflow Condition | Sn Phase | Sn—Cu Alloy Phase | Cu Phase | 105° C. | 150° C. |
| Ex. | 21 | 0.90 | 0.20 | 400° C. × 10 sec. | 0.48 | 0.93 | 0.00 | >3000 | >3000 |
| | 22 | 0.90 | 0.50 | 400° C. × 10 sec. | 0.50 | 1.01 | 0.12 | >3000 | >3000 |
| | 23 | 0.90 | 0.80 | 400° C. × 10 sec. | 0.49 | 1.00 | 0.45 | >3000 | >3000 |
| | 24 | 0.90 | 1.00 | 400° C. × 10 sec. | 0.50 | 1.02 | 0.67 | >3000 | >3000 |
| | 25 | 0.50 | 0.80 | 400° C. × 10 sec. | 0.12 | 1.02 | 0.47 | >3000 | >3000 |
| | 26 | 0.60 | 0.80 | 400° C. × 10 sec. | 0.21 | 1.04 | 0.45 | >3000 | >3000 |
| | 27 | 1.20 | 0.80 | 400° C. × 10 sec. | 0.79 | 1.02 | 0.46 | >3000 | >3000 |
| | 28 | 1.80 | 0.80 | 400° C. × 10 sec. | 1.43 | 1.03 | 0.47 | >3000 | >3000 |
| Com. | 8 | 2.00 | 0.80 | 400° C. × 10 sec. | 1.54 | 1.01 | 0.47 | 1700 | 1500 |
| Ex. | 9 | 2.00 | 0.80 | 400° C. × 30 sec. | 1.18 | 1.53 | 0.13 | 1600 | 1600 |
| | 10 | 0.90 | 1.25 | 400° C. × 10 sec. | 0.49 | 1.02 | 0.87 | 800 | 1100 |

TABLE 3

| | | Thickness After Electrodeposition (μm) | | | | Thickness After Reflow (μm) | | | Plate peeling Time (h) | |
|---|---|---|---|---|---|---|---|---|---|---|
| | No. | Sn Phase | Cu Phase | Ni Phase | Reflow Condition | Sn Phase | Sn—Cu Alloy Phase | Ni Phase | 105° C. | 150° C. |
| Ex | 29 | 0.90 | 0.20 | 0.15 | 400° C. × 10 sec. | 0.48 | 0.99 | 0.15 | >3000 | >3000 |
| | 30 | 0.90 | 0.20 | 0.50 | 400° C. × 10 sec. | 0.48 | 1.01 | 0.50 | >3000 | >3000 |
| | 31 | 0.90 | 0.20 | 0.70 | 400° C. × 10 sec. | 0.49 | 0.98 | 0.69 | >3000 | >3000 |
| | 32 | 0.50 | 0.15 | 0.20 | 400° C. × 10 sec. | 0.13 | 1.02 | 0.19 | >3000 | >3000 |
| | 33 | 0.60 | 0.15 | 0.20 | 400° C. × 10 sec. | 0.25 | 1.03 | 0.19 | >3000 | >3000 |
| | 34 | 1.20 | 0.15 | 0.20 | 400° C. × 10 sec. | 0.75 | 1.01 | 0.20 | >3000 | >3000 |
| | 35 | 1.80 | 0.15 | 0.20 | 400° C. × 10 sec. | 1.37 | 1.00 | 0.20 | >3000 | >3000 |
| Com | 11 | 2.00 | 0.15 | 0.20 | 400° C. × 10 sec. | 1.57 | 1.01 | 0.20 | 2600 | 2400 |
| Ex | 12 | 2.00 | 0.60 | 0.20 | 400° C. × 30 sec. | 1.32 | 1.53 | 0.19 | 2200 | 2500 |
| | 13 | 0.90 | 0.20 | 0.90 | 400° C. × 10 sec. | 0.47 | 0.98 | 0.90 | 2200 | 2800 |

Table 2 (Examples 21 to 28 and Comparative Examples 8 to 10) is the data for the Cu undercoat. In Examples 21 to 28 which are the alloys of the present invention, plate peeling had not occurred when heated at both 105° C. and 150° C. for 3000 hours.

In Examples 21 to 24 and Comparative Example 10, the electrodeposition thickness of Sn was 0.9 μm, and the thickness of the Cu undercoat was altered. In Comparative Example 10 where the thickness of the Cu undercoat after reflow treatment was greater than 0.8 μm, the peeling time was shorter than 3000 hours at both 105° C. and 150° C.

In Examples 23, 25 to 28 and Comparative Examples 8 to 9, the electrodeposition thickness of the Cu undercoat was 0.8 μm, and the thickness of Sn was altered. In Comparative Example 8 where the electrodeposition thickness of Sn was 2.0 μm and reflow treatment was preformed under the same conditions as others, the thickness of the Sn phase after reflow treatment was greater than 1.5 μm. In addition, in Comparative Example 9 where the electrodeposition thickness of Sn was 2.0 μm and the reflow time was extended, the thickness of the Sn—Cu alloy phase after reflow treatment was greater than 1.5 μm. In these alloys where the thickness of the Sn phase or Sn—Cu alloy phase is outside the specified range of the present invention, the peeling time was shorter than 3000 hours at both 105° C. and 150° C.

Table 3 (Examples 29 to 35 and Comparative Examples 11 to 13) is the data for the Cu/Ni undercoat. In Examples 29 to 35 which are the alloy of the present invention, plate peeling had not occurred when heated at both 105° C. and 150° C. for 3000 hours.

In Examples 29 to 31 and Comparative Example 13, the electrodeposition thickness of Sn was 0.9 μm, the electrodeposition thickness of Cu was 0.2 μm, and the thickness of the Ni undercoat was altered. In Comparative Example 13 where the thickness of the Ni phase after reflow treatment was greater than 0.8 μm, the peeling time was shorter than 3000 hours at both 105° C. and 150° C.

In Examples 32 to 35 and Comparative Example 11, the electrodeposition thickness of the Cu undercoat was 0.15 μm, the electrodeposition thickness of the Ni undercoat was 0.2 μm, and the thickness of Sn was altered. In Comparative Example 11 where the thickness of the Sn phase after reflow treatment was greater than 1.5 μm, the peeling time was shorter than 3000 hours at both 105° C. and 150° C.

In Comparative Example 12 where the electrodeposition thickness of Sn was 2.0 μm, the electrodeposition thickness of Cu was 0.6 μm, and the reflow time was extended compared to other Examples, the thickness of the Sn—Cu alloy phase was greater than 1.5 μm, and the peeling time was shorter than 3000 hours at both 105° C. and 150° C.

The invention claimed is:

1. A Cu—Zn alloy Sn plating strip superior in thermal peel resistance, that has a Cu—Zn alloy strip that comprises 15 to 40% by mass of Zn and a balance of Cu and unavoidable impurities, wherein the total concentration of P, As, Sb and Bi is 100 ppm by mass or less, the total concentration of Ca and Mg is 100 ppm by mass or less, the concentration of O is 30 ppm by mass or less, and the concentration of S is 30 ppm by mass or less, as a base material, and wherein a plating coating is constructed by layers of an Sn phase, an Sn—Cu alloy phase, and optionally a Cu phase, in that order from the surface to the base material, wherein the thickness of the Sn phase is 0.1 to 1.5 μm, the thickness of the Sn—Cu alloy phase is 0.1 to 1.5 μm, and the thickness of the Cu phase is not more than 0.8 μm.

2. A Cu—Zn alloy Sn plating strip superior in thermal peel resistance, that has a Cu—Zn alloy strip that comprises 15 to 40% by mass of Zn and a balance of Cu and unavoidable impurities, wherein the total concentration of P, As, Sb and Bi is 100 ppm by mass or less, the total concentration of Ca and Mg is 100 ppm by mass or less, the concentration of O is 30 ppm by mass or less, and the concentration of S is 30 ppm by mass or less, as a base material, and wherein a plating coating is constructed by layers of an Sn phase, Sn—Cu alloy phase, and an Ni phase, in that order from the surface to the base material, wherein the thickness of the Sn phase is 0.1 to 1.5 μm, the thickness of the Sn—Cu alloy phase is 0.1 to 1.5 μm, and the thickness of the Ni phase is 0.1 to 0.8 μm.

3. A Cu—Zn alloy Sn plating strip that comprises:

a Cu—Zn alloy strip comprising 15 to 40% by mass of Zn, at least one selected from the group consisting of Sn, Ni, Si, Fe, Mn, Co, Ti, Cr, Zr, Al and Ag in a total concentration in the range of 0.01 to 5.0% by mass, and a balance of Cu and unavoidable impurities, wherein the total concentration of P, As, Sb and Bi is 100 ppm by mass or less, the total concentration of Ca and Mg is 100 ppm by mass or less, the concentration of 0 is 30 ppm by mass or less, and the concentration of S is 30 ppm by mass or less, as a base material, and a plating coating constructed by layers of an Sn phase, an Sn—Cu alloy phase, and optionally a Cu phase surface, in that order from the surface to the base material, wherein the thickness of the Sn phase is 0.1 to 1.5 μm, the thickness of the Sn—Cu alloy phase is 0.1 to 1.5 μm, and the thickness of the Cu phase is not more than 0.8 μm.

4. A Cu—Zn alloy Sn plating strip a Cu—Zn alloy strip comprising 15 to 40% by mass of Zn, at least one selected from the group consisting of Sn, Ni, Si, Fe, Mn, Co, Ti, Cr, Zr, Al and Ag in a total concentration in the range of 0.01 to 5.0% by mass, and a balance of Cu and unavoidable impurities, wherein the total concentration of P, As, Sb and Bi is 100 ppm by mass or less, the total concentration of Ca and Mg is 100 ppm by mass or less, the concentration of 0 is 30 ppm by mass or less, and the concentration of S is 30 ppm by mass or less, as a base material, and a plating coating constructed by layers of an Sn phase, Sn—Cu alloy phase, and an Ni phase, in that order from the surface to the base material, wherein the thickness of the Sn phase is 0.1 to 1.5 μm, the thickness of the Sn—Cu alloy phase is 0.1 to 1.5 μm, and the thickness of the Ni phase is 0.1 to 0.8 μm.

* * * * *